US009938879B2

(12) United States Patent
Shomura et al.

(10) Patent No.: US 9,938,879 B2
(45) Date of Patent: Apr. 10, 2018

(54) OUTBOARD MOTOR

(71) Applicant: SUZUKI MOTOR CORPORATION, Hamamatsu-Shi, Shizuoka (JP)

(72) Inventors: Nobuyuki Shomura, Hamamatsu (JP); Ryuji Hamada, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 15/058,929

(22) Filed: Mar. 2, 2016

(65) Prior Publication Data

US 2016/0305316 A1 Oct. 20, 2016

(30) Foreign Application Priority Data

Apr. 14, 2015 (JP) ..... 2015-082568

(51) Int. Cl.
*F01N 13/10* (2010.01)
*F01N 13/00* (2010.01)
*F01N 13/12* (2010.01)

(52) U.S. Cl.
CPC ..... *F01N 13/10* (2013.01); *F01N 13/0093* (2014.06); *F01N 13/0097* (2014.06); *F01N 13/12* (2013.01); *F01N 2590/021* (2013.01)

(58) Field of Classification Search
CPC .. F01N 13/004; F01N 2590/021; F01N 13/10; F01N 13/102; F01N 13/105; F01N 13/107; F01N 13/12
See application file for complete search history.

(56) References Cited

U.S. PATENT DOCUMENTS 6,662,555 B1 12/2003 Ishii
8,366,501 B2 * 2/2013 Kazuta ..... B63H 21/32 440/89 H
8,814,619 B2 * 8/2014 Maekawa ..... B63H 20/24 440/89 H
9,260,171 B2 * 2/2016 Ochiai ..... B63H 20/28
2014/0242859 A1 * 8/2014 Ochiai ..... B63H 20/28 440/88 M
2016/0273447 A1 * 9/2016 Nakayama ..... F02B 75/22

FOREIGN PATENT DOCUMENTS

JP 2000356123 A 12/2000

* cited by examiner

*Primary Examiner* — Andrew Polay
(74) *Attorney, Agent, or Firm* — Troutman Sanders LLP

(57) ABSTRACT

Disclosed is an outboard motor including an exhaust manifold having a first passage that is provided with a plurality of first openings connected to a plurality of exhaust ports and extends vertically, and a second passage that is arranged under the first passage and has a second opening provided in a lower end portion and connected to a third passage formed in the engine holder. The first and second passages of the exhaust manifold are formed integrally, and the exhaust manifold is formed separately from the cylinder head and the cylinder block and is detachably installed.

2 Claims, 9 Drawing Sheets

OUTBOARD MOTOR

CROSS-REFERENCE TO RELATED APPLICATION

This application is based upon and claims the benefit of priority of the prior Japanese Patent Application No. 2015-082568, filed on Apr. 14, 2015, the entire contents of which are incorporated herein by reference.

BACKGROUND OF THE INVENTION

Field of the Invention

The present invention relates to an outboard motor, and more particularly, to an outboard motor preferably employed in a ship model having an engine provided with a catalytic converter.

Description of the Related Art

An outboard motor mounted on a small boat and the like is configured such that an upper unit and a guide exhaust are connected to an upper portion of a lower unit provided with a propeller, an engine is supported and fixed on the guide exhaust, the engine is covered by an engine cover, and the propeller is rotated and driven by the engine. An exhaust gas from the engine is discharged to the seawater through an exhaust passage vertically provided on the side surface of the engine across upper and lower units. In such an engine of the outboard motor, a catalytic converter may be provided in the exhaust passage in order to purify the exhaust gas and comply with an exhaust gas control requirement in some cases.

For example, in Patent Document 1, there is discussed an outboard motor engine having a crankshaft arranged vertically, in which an exhaust passage communicating with an exhaust port is formed in the side surface of the engine, and a catalyst is arranged in parallel with a flow of the exhaust gas.

In such a type of outboard motors, output power may be differently set under the same basic engine configuration in some cases. In addition, a specific level of the exhaust gas control requirement may be differently established depending on nations or regions. Therefore, it is necessary to change a configuration of the catalytic converter depending on nations or regions under the same engine configuration. Furthermore, in some cases, there is a demand for sharing of the engine between a catalyst-mounted model and a non-catalyst-mounted model. Conventional outboard motors are not easy to satisfy such a demand.

CITATION LIST

Patent Documents

[Patent Document 1] Japanese Laid-open Patent Publication No. 2000-356123

SUMMARY OF THE INVENTION

In view of the aforementioned problems, it is therefore an object of the present invention to provide an outboard motor capable of accommodating sharing of the engine between the catalyst-mounted model and the non-catalyst-mounted model.

According to an aspect of the present invention, there is disclosed an outboard motor including: a four-cycle engine having a cylinder block having a plurality of cylinders arranged side by side along a vertical direction, and a cylinder head that forms each combustion chamber in cooperation with the cylinders of the cylinder block and has exhaust ports connected to the combustion chambers; an engine holder that supports the four-cycle engine and connects the engine to a lower unit; and an exhaust manifold provided with a first passage that has a plurality of first openings connected to the exhaust ports and extends vertically and a second passage that is arranged under the first passage and has a second opening provided in a lower end portion and connected to a third passage formed in the engine holder, wherein the first and second passages of the exhaust manifold are formed integrally, and the exhaust manifold is formed separately from the cylinder head and the cylinder block and is detachably installed.

In the outboard motor described above, the first and second passages of the exhaust manifold directly may communicate with each other, and the exhaust manifold may not be provided with an exhaust gas cleaning catalyst inside the exhaust passage.

In the outboard motor described above, the first and second passages of the exhaust manifold may be partitioned by a partitioning wall, and the exhaust manifold may have a fourth passage branching from an upper portion of the first passage, communicating with the second passage, and internally having an exhaust gas cleaning catalyst.

In the outboard motor described above, the fourth passage of the exhaust manifold may extend vertically along the first passage and is arranged in line with a cylinder block side in front of the first passage or a cylinder head side in rear of the first passage, or in line with both the cylinder block side and the cylinder head side.

In the outboard motor described above, the fourth passage of the exhaust manifold may be detachably installed to a body of the exhaust manifold provided with the first and second passages, and a coupling portion dividable into a first passage side and a second passage side may be formed in the middle of the fourth passage.

In the outboard motor described above, an oxygen sensor for detecting an oxygen concentration in the exhaust gas may be disposed in an upper portion of the first passage or in the second passage of the exhaust manifold.

DETAILED DESCRIPTION OF THE PREFERRED EMBODIMENTS

A description will now be made for an outboard motor according to a preferable embodiment of the present invention with reference to the accompanying drawings.

Figure 1:
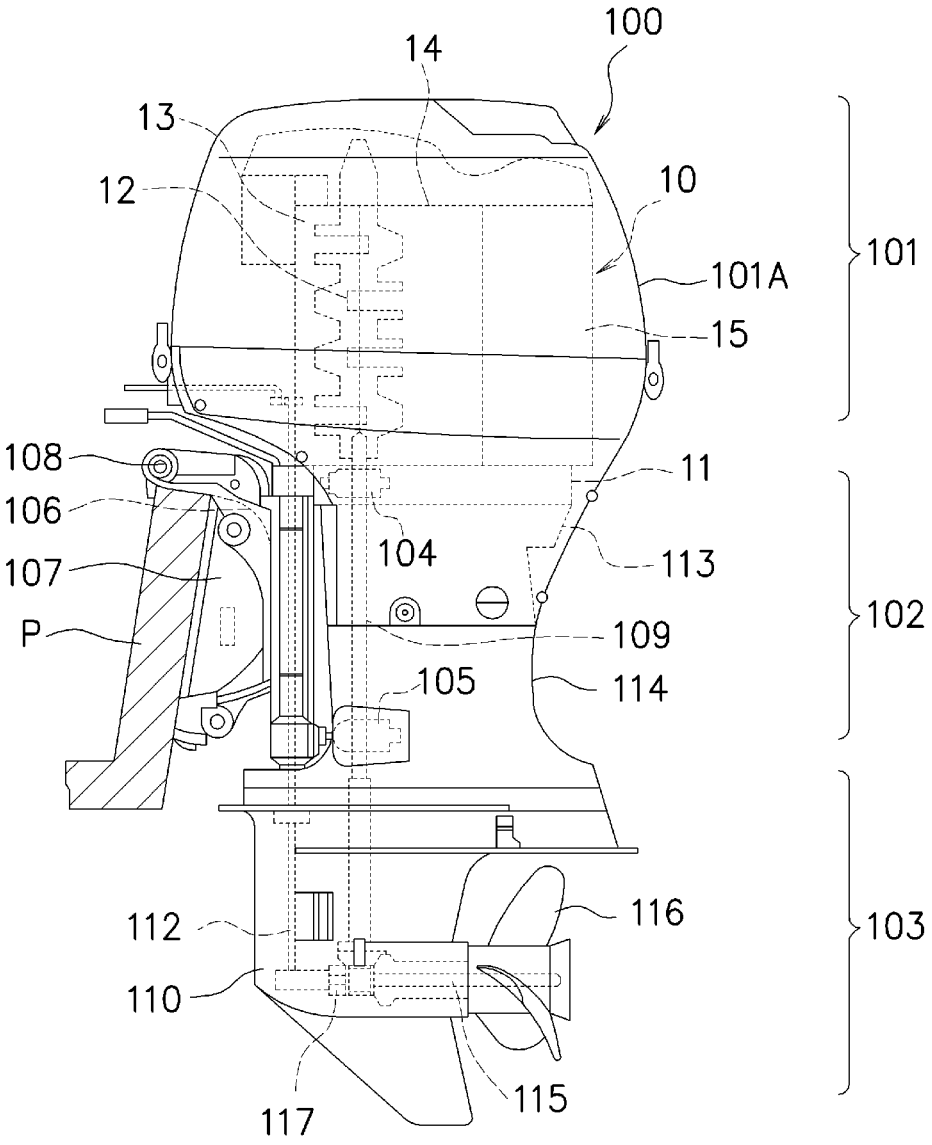
FIG. 1 is a left side view illustrating a schematic configuration example of the entire outboard motor according to the present invention.

FIG. 1 is a left side view illustrating a schematic configuration example of an outboard motor 100 according to the present invention. In this case, the outboard motor 100 is fixed to a stem plate P of a ship hull in its front side as illustrated in FIG. 1. It is noted that, in the following description for each drawing, the arrow Fr denotes a front side of the outboard motor 100, the arrow Rr denotes a rear side of the outboard motor 100, the arrow R denotes a right side of the outboard motor 100, and the arrow L denotes a left side of the outboard motor 100 as necessary.

In the entire configuration of the outboard motor 100, an upper unit 101, a middle unit 102, and a lower unit 103 are sequentially arranged from the upside to the downside. In the upper unit 101, the engine 10 is vertically mounted and supported by an engine holder 11 such that a crankshaft 12 is directed to a vertical direction. As the engine 10, various engine types such as a V-type multi-cylinder engine or an in-line multi-cylinder engine may be employed. A cylinder block 14, a cylinder head 15, and a cylinder head cover 16 are sequentially assembled to a crank casing 13 that supports the crankshaft 12. It is noted that the engine 10 is covered by the engine cover 101A.

The middle unit 102 is supported by upper and lower mounts 104 and 105 horizontally pivotably around a support shaft set in a swivel bracket 106. A clamp bracket 107 is provided in both sides of the swivel bracket 106, so that the middle unit 102 is fixed to the stem plate P of the ship hull by using the clamp bracket 107. The swivel bracket 106 is supported vertically pivotably around a tilt shaft 108 set in a left-right direction.

In the middle unit 102, a drive shaft 109 connected to a lower end portion of the crankshaft 12 of the engine 10 is arranged to vertically penetrate, so that a drive force of the drive shaft 109 is transmitted to a propeller shaft 111 arranged in a gear casing 110 of the lower unit 103. A shift rod 112 for shifting a gear position to forward or backward is arranged in front of the drive shaft 109 in parallel with the vertical direction. In addition, the middle unit 102 is also provided with an oil pan 113 for storing oil for lubricating the engine 10. It is noted that the middle unit 102 has a drive shaft housing 114 for housing the drive shaft 109.

In the lower unit 103, the gear casing 110 internally has a plurality of gear groups 117 and the like to rotatably drive the propeller 116 by using the propeller shaft 115 by virtue of the drive force of the drive shaft 109. In the gear group 117, a gear provided in the drive shaft 109 extending downward from the middle unit 102 meshes with the gear of the gear casing 110 so as to finally rotate the propeller 116. However, if a shift operation is performed by using the shift rod 112, a power transmission path of the gear group 117 in the gear casing 110 is switched, that is, shifted.

Figure 2:
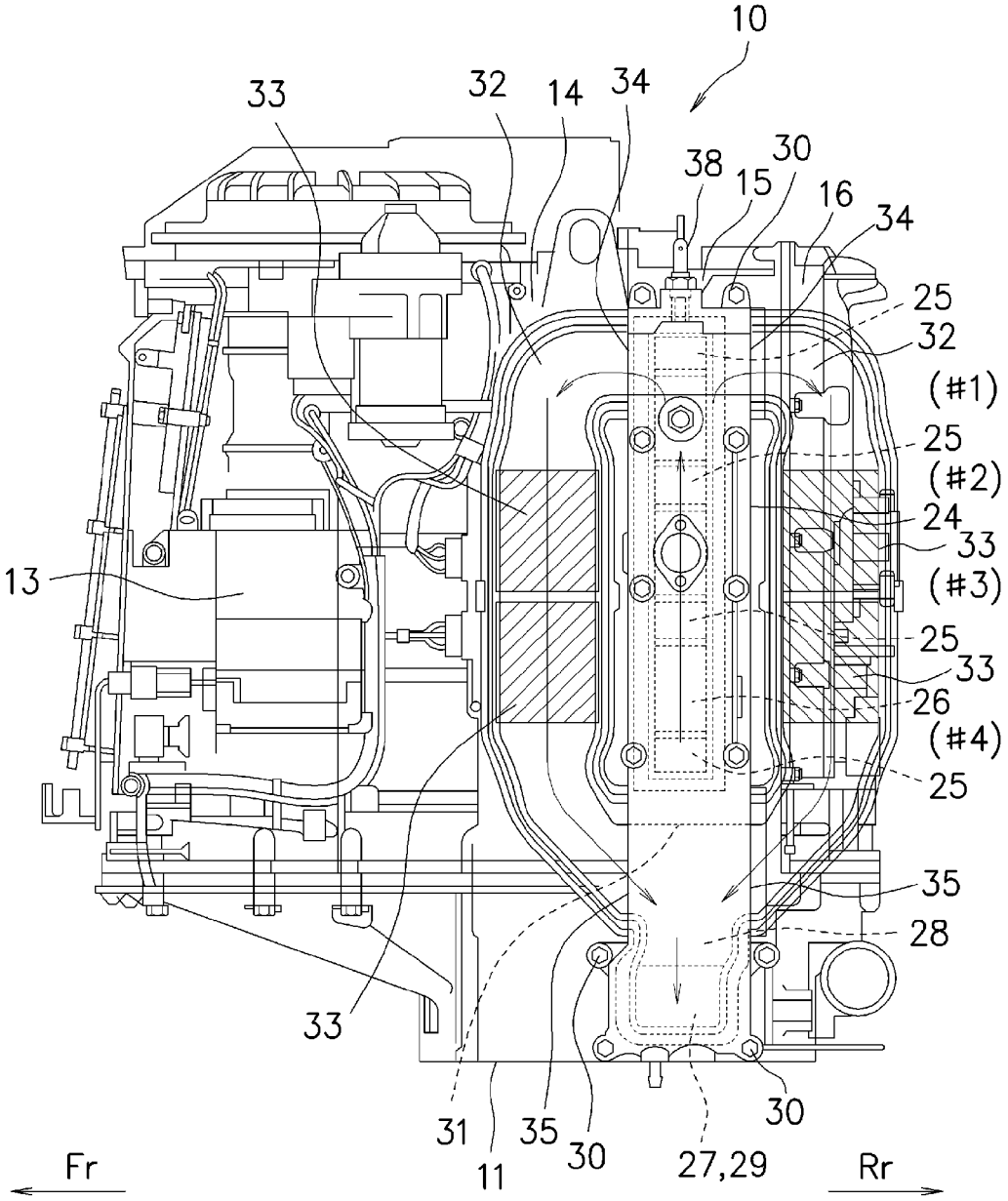
FIG. 2 is a side view illustrating an engine of the outboard motor according to the present invention.
Figure 3:
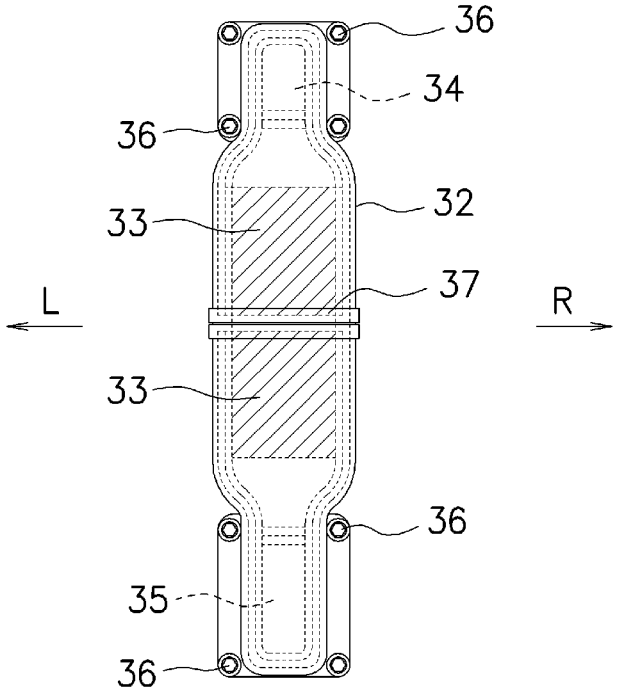
FIG. 3 is a rear view illustrating an exhaust manifold and its surroundings according to an embodiment of the present invention.
Figure 4:
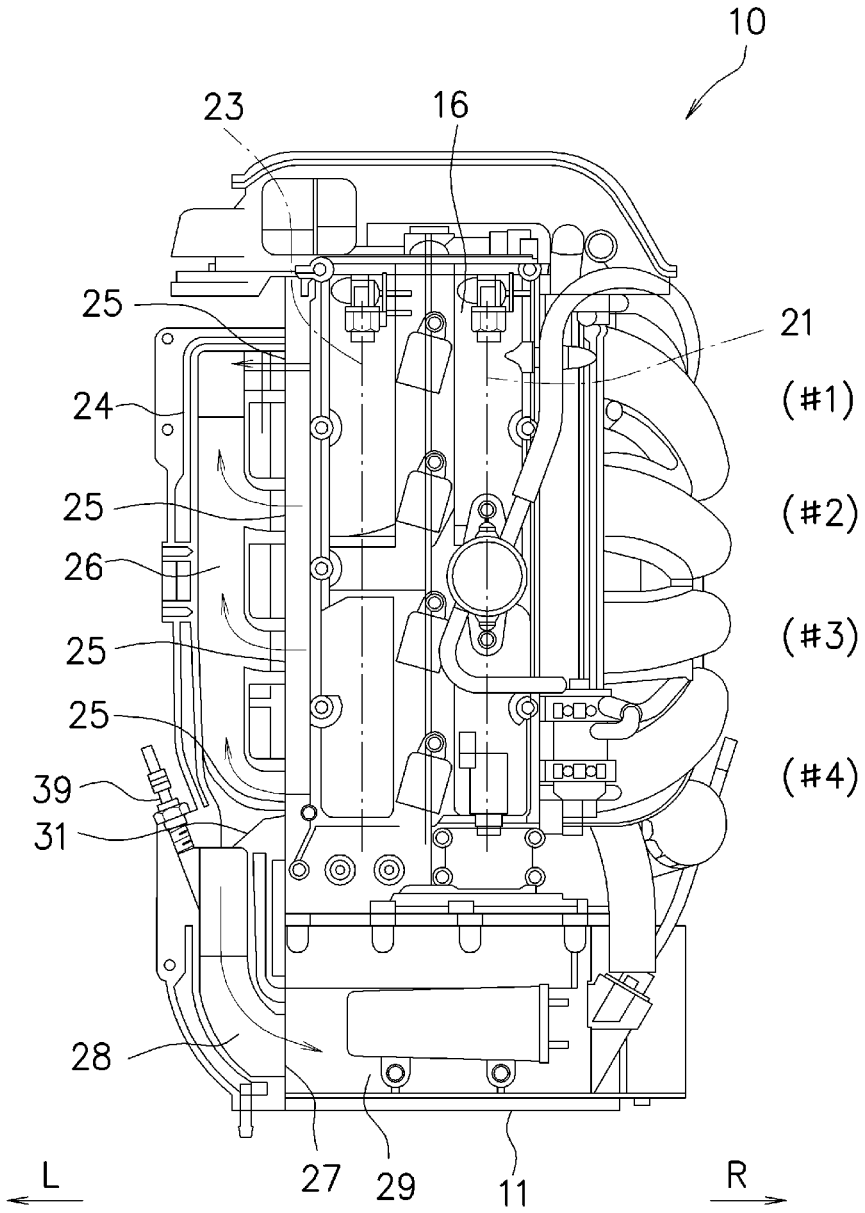
FIG. 4 is a rear view illustrating the engine of the outboard motor according to the present invention.
Figure 5:
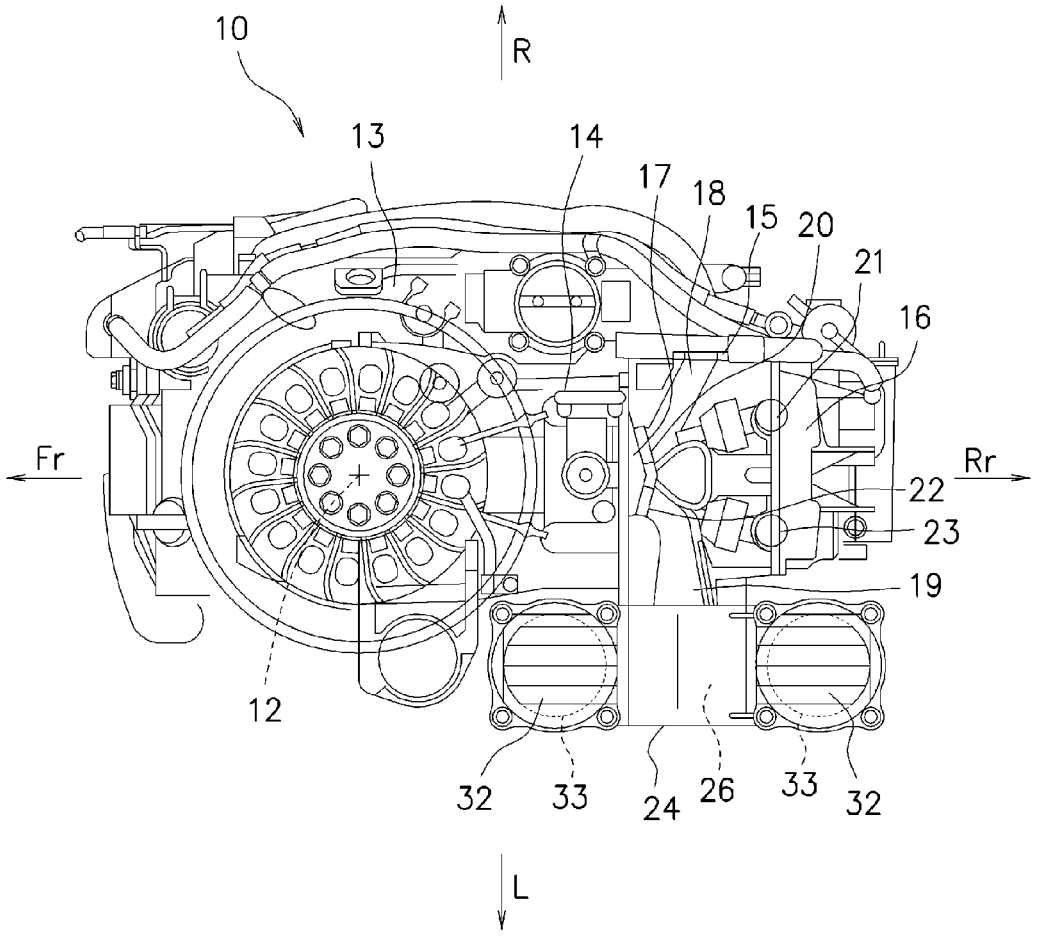
FIG. 5 is a top view illustrating the engine of the outboard motor according to the present invention.

FIGS. 2 to 5 illustrate an exemplary engine 10 according to this embodiment. FIG. 2 is a left side view illustrating the engine 10. FIG. 4 is a rear view illustrating the engine 10. FIG. 5 is a top view illustrating the engine 10. It is noted that FIG. 3 is a rear view illustrating an exhaust manifold and its surroundings according to this embodiment. It is assumed that the engine 10 of this embodiment is an in-line 4-cylinder engine, in which four cylinders including the first cylinder #1, the second cylinder #2, the third cylinder #3, and the fourth cylinder #4 are sequentially arranged from the upside as illustrated in FIG. 4. The engine 10 is mounted onto the engine holder 11 in the fourth cylinder #4 side such that the crank casing 13 is arranged in the front side, and the cylinder block 14 and the cylinder head 15 are arranged in the rear side. Although the engine 10 will be described in brief hereinafter, some of components thereof may be appropriately omitted or not as necessary for simplicity purposes.

In the crank casing 13, the crankshaft 12 is supported by a plurality of journal bearings in its upper end, middle, and lower end portions rotatably inside the crank casing 13. The lower end of the crankshaft 12 may also be coupled to the upper end of the drive shaft 109, for example, by interposing a pair of coupling gears (reduction gears). As a result, the rotational force of the crankshaft 12 is transmitted to the drive shaft 109.

The cylinder block 14 is internally provided with cylinder bores for each cylinder, so that pistons are inwardly fitted to the cylinder bores in a reciprocatable manner (in the front-rear direction). The piston is connected to a crank pin of the crankshaft 12 by interposing a connecting rod. As a result, a reciprocating motion of the piston inside the cylinder bore is converted into a rotational motion of the crankshaft 12, and is transmitted to the drive shaft 109 as the output power of the engine 10.

Referring to FIG. 5, the cylinder head 15 is provided with combustion chambers 17 matching cylinder bores of each cylinder and intake and exhaust ports 18 and 19 communicating with respective combustion chambers 17. For the open/close operation of the intake port 18, a communicating portion to the combustion chamber 17 is controlled by an intake valve 20. In this case, the intake valve 20 is driven by a cam provided in an intake cam shaft 21 extending vertically. In addition, for the open/close operation of the exhaust port 19, a communicating portion to the combustion chamber 17 is controlled by an exhaust valve 22. In this case, the exhaust valve 22 is driven by a cam provided in an exhaust cam shaft 23 extending vertically. It is noted that, according to this embodiment, each cylinder may have a four-valve structure having a pair of valves for each of the intake and exhaust sides.

On top of the combustion chamber 17 of each cylinder, an ignition plug is installed, so that a mixed gas supplied to the inside of the combustion chamber 17 is ignited by the ignition plug. In addition, a combustion gas exploded and combusted inside each cylinder bore of each cylinder is discharged from the exhaust port 19 to an exhaust manifold 24 described below. In each cylinder, the exhaust manifold 24 provided in the outer side portion of the cylinder bore of the cylinder block 14 is connected to the exhaust port 19 to communicate with each other. As illustrated in FIGS. 2 and 4, the exhaust manifold 24 is provided to vertically extend on the left side surface portion of the cylinder head 15 so that the exhaust gases from each exhaust port 19 are joined. The confluent exhaust gas passes through the exhaust manifold 24 and is finally guided to the lower side of the engine 10 as described below. Then, the exhaust gas passes through an exhaust passage formed inside the engine holder 11 and is finally discharged to the water.

As an exemplary configuration of the exhaust manifold 24 of the outboard motor 100 according to the present invention, a catalyst-mounted model will be described. As illustrated in FIGS. 2 and 4, the exhaust manifold 24 is provided with a first passage 26 that has a plurality of first openings 25 (four openings in this embodiment) connected to a plurality of exhaust ports 19 (four exhaust ports in this embodiment) and extends vertically, and a second passage 28 that is arranged under the first passage 26 and has a second opening 27 provided in the lower end portion of the exhaust manifold 24 and connected to a third passage 29 formed in the engine holder 11. The exhaust manifold 24 has a cavity structure having an approximately rectangular cross-sectional shape. In particular, the first and second passages 26 and 28 of the exhaust manifold 24 are formed integrally, and the exhaust manifold 24 is formed separately from the cylinder head 15 and the cylinder block 14 and is detachably installed.

As illustrated in FIG. 2, the exhaust manifold 24 is fastened to the left side surface portion of the cylinder head 15 by using a plurality of bolts 30 as fastening means. The exhaust manifold 24 can be uninstalled from the cylinder head 15 by removing the bolts 30.

As illustrated in FIGS. 2 and 4, the first and second passages 26 and 28 of the exhaust manifold 24 are partitioned by a partitioning wall 31. As illustrated in FIG. 2, the exhaust manifold 24 is additionally provided with a fourth passage 32 that branches from the upper portion of the first passage 26, communicates with the second passage 28, and internally has an exhaust gas cleaning catalyst 33. Therefore, in this embodiment, a pair of exhaust gas cleaning catalysts 33 is mounted inside the exhaust gas path.

In this embodiment, as illustrated in FIG. 2, each of the fourth passages 32 vertically extends along the first passage 26 and is arranged in line with the side portion of the cylinder block 14 (left side) in front of the first passage 26 and the side portion of the cylinder head 15 (left side) in rear of the first passage 26.

The upper portion of the fourth passage 32 communicates with the upper portion of the first passage 26 through the communication hole 34. In addition, the lower portion of the fourth passage 32 communicates with the second passage 28 through the communication hole 35.

Each fourth passage 32 is detachably installed to the exhaust manifold 24 (manifold body) provided with the first and second passages 26 and 28. In this case, each fourth passage 32 is fastened to the front and rear surface portions of the exhaust manifold 24 by using a plurality of bolts 36 and the like as fastening means as illustrated in FIG. 3. Each fourth passage 32 may be uninstalled from the exhaust manifold 24 by removing the bolts 36.

In addition, as illustrated in FIG. 3, a coupling portion 37 dividable to the first passage 26 side and the second passage 28 side is formed in the middle of the fourth passage 32. The upper and lower end portions of the fourth passage 32 vertically bisected by the coupling portion 37 are formed in a flange shape, and the bisected upper and lower portions of the fourth passage 32 are fastened to each other by bolts and the like. The exhaust gas cleaning catalyst 33 may be installed to an opening formed in a dividing portion of the fourth passage 32 vertically bisected.

Furthermore, an oxygen sensor 38 for detecting an oxygen concentration in the exhaust gas is installed in the upper portion of the first passage 26 as illustrated in FIG. 2. Using the oxygen sensor 38, it is possible to detect an oxygen concentration in the upstream side from the exhaust gas cleaning catalyst 33.

Moreover, as illustrated in FIG. 4, an oxygen sensor 39 for detecting an oxygen concentration in the exhaust gas is similarly installed in the second passage 28 as necessary. Using the oxygen sensor 39, it is possible to detect an oxygen concentration in the downstream side from the exhaust gas cleaning catalyst 33.

In the exhaust manifold 24 of this embodiment, the exhaust gases from each exhaust port 19 flow to the first opening 25 and are joined in the first passage 26. The confluent exhaust gas flows upward inside the first passage 26 and branches to each fourth passage 32 through the communication hole 34 in the upper portion of the first passage 26. The exhaust gas then flows downward inside the fourth passage 32 while it passes through the exhaust gas cleaning catalyst 33. Then, the exhaust gas flows to the second passage 28 through the communication hole 35 from the lower portion of the exhaust gas cleaning catalyst 33. The exhaust gas joined from each fourth passage 32 to the second passage 28 flows to the third passage 29 of the engine holder 11 through the second opening 27, passes through the exhaust passage provided in the lower unit 103, and is then finally discharged to the water.

Figure 6:
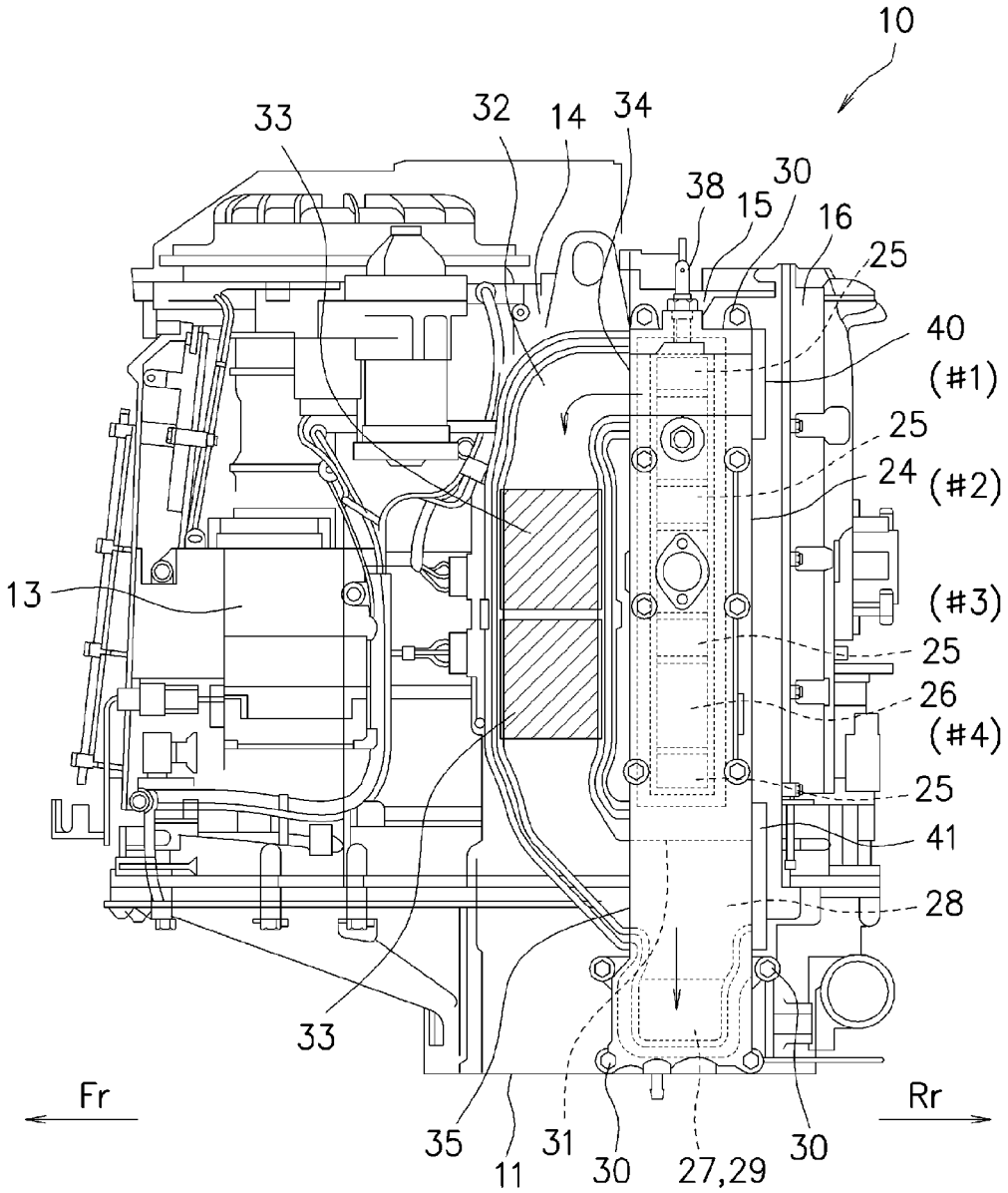
FIG. 6 is a side view illustrating the exhaust manifold of the outboard motor according to another aspect of the present invention.
Figure 7:
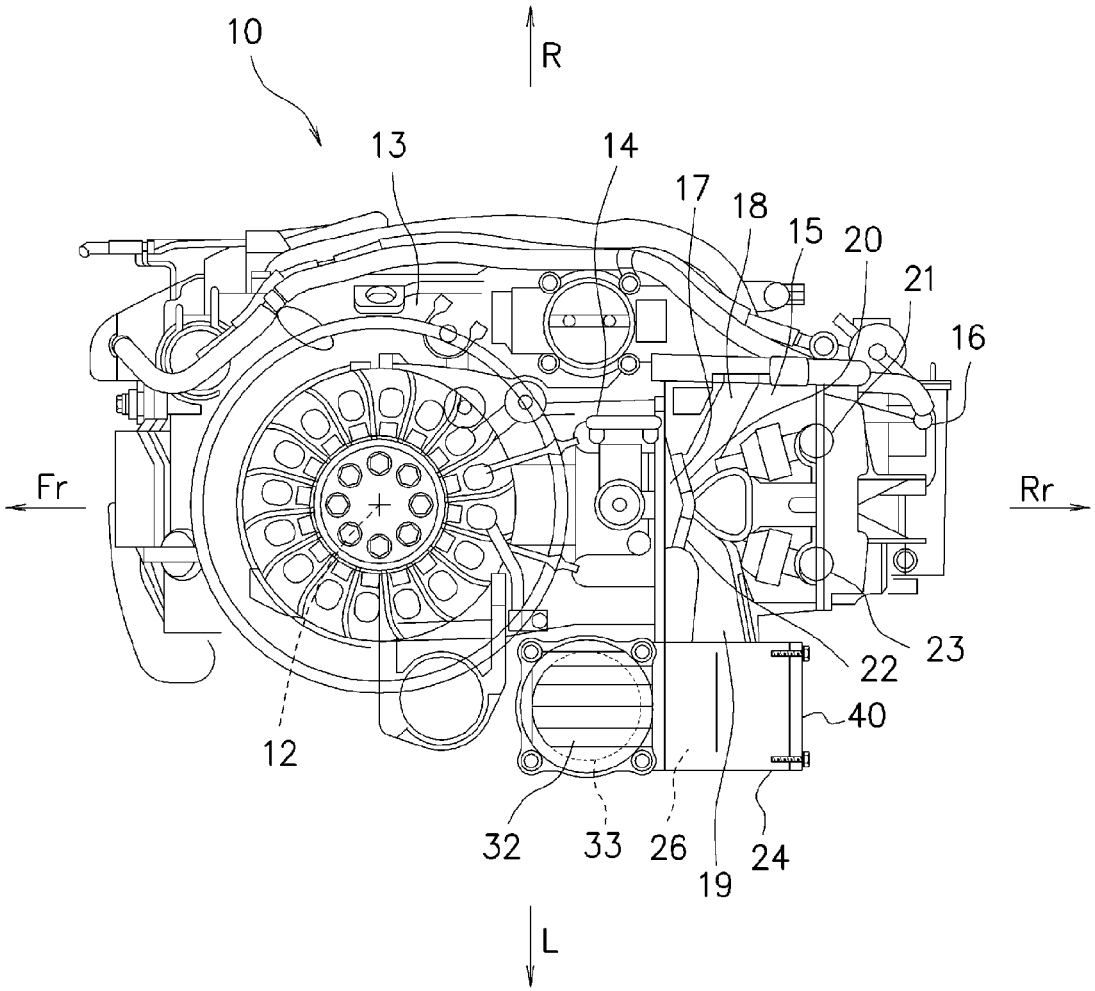
FIG. 7 is a top view illustrating the exhaust manifold of the outboard motor according to another aspect of the present invention.

FIGS. 6 and 7 illustrate an exhaust manifold 24 in the outboard motor 100 according to another aspect of the present invention in a catalyst-mounted model. FIG. 6 is a left side view illustrating the engine 10, and FIG. 7 is a top view illustrating the engine 10. In this embodiment, the fourth passage 32 extends vertically along the first passage 26 and is arranged in the side portion of the cylinder block 14 in front of the first passage 26. That is, the fourth passage 32 is provided only in one side in front of the first passage 26. The fourth passage 32 is internally provided with the exhaust gas cleaning catalyst 33. Therefore, in this embodiment, a single exhaust gas cleaning catalyst 33 is provided in the exhaust gas path. Other parts are substantially similar to those of the aforementioned case.

It is noted that the communication holes 34 and 35 provided in the rear surface of the exhaust manifold 24 are provided with cover plates 40 and 41, respectively. Using the cover plates 40 and 41, it is possible to cover the communication holes 34 and 35.

In the exhaust manifold 24 according to this embodiment, the exhaust gas from the exhaust port 19 flows to the first opening 25 and is joined in the first passage 26. This confluent gas flows to the upper portion inside the first passage 26 and then flows to the fourth passage 32 through the communication hole 34 provided on the front surface in the upper portion of the first passage 26. Furthermore, the exhaust gas flows downward inside the fourth passage 32 while it passes through the exhaust gas cleaning catalyst 33. Then, the exhaust gas flows to the second passage 28 through the communication hole 35 provided on the front surface in the lower portion of the fourth passage 32. The exhaust gas flowing from the fourth passage 32 to the second passage 28 flows to the third passage 29 of the engine holder 11 through the second opening 27, passes through the exhaust passage provided in the lower unit 103, and is then finally discharged to the water.

Figure 8:
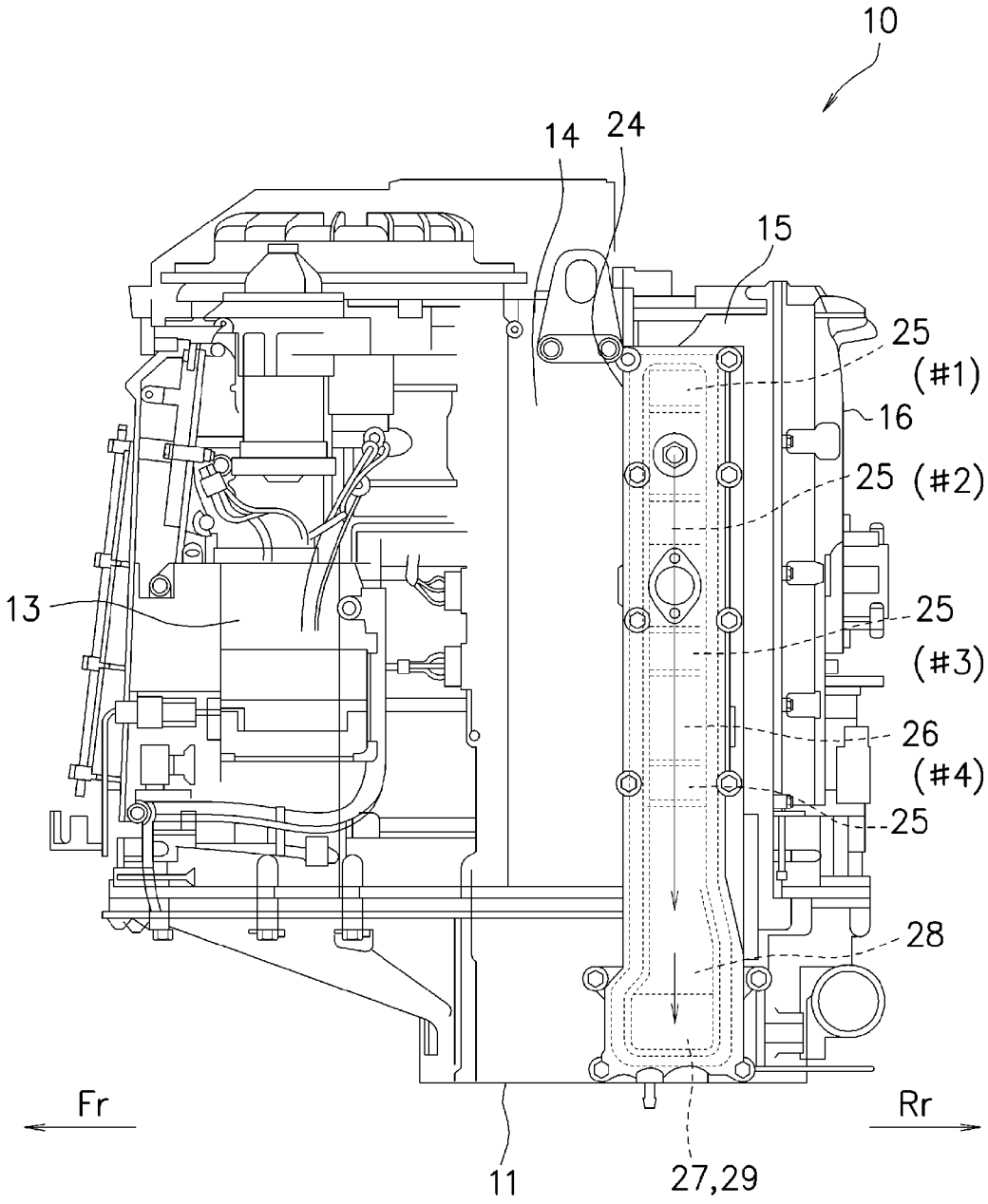
FIG. 8 is a side view illustrating the exhaust manifold of the outboard motor according to still another aspect of the present invention.
Figure 9:
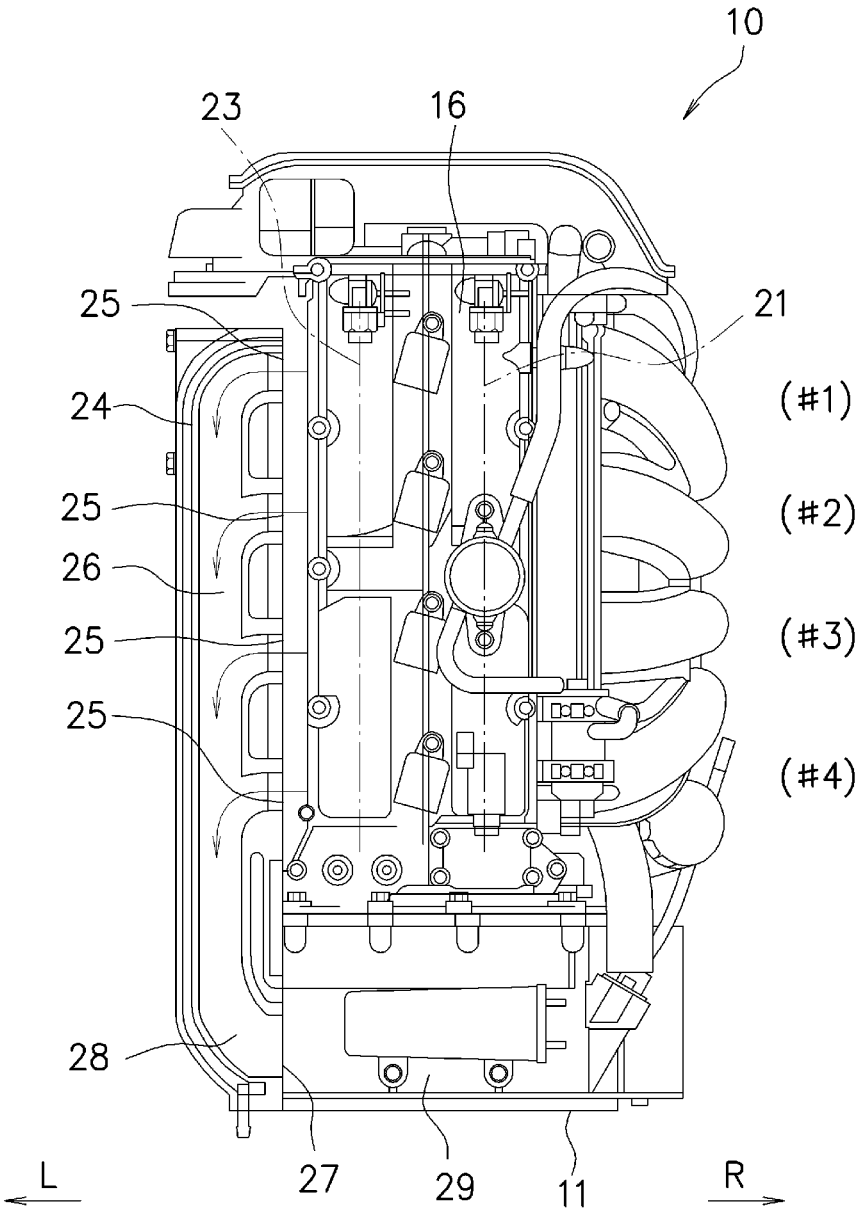
FIG. 9 is a top view illustrating the exhaust manifold of the outboard motor according to still another aspect of the present invention.

FIGS. 8 and 9 illustrate an exhaust manifold 24 in the outboard motor 100 according to an aspect of the present invention in a non-catalyst-mounted model. FIG. 8 is a left side view illustrating the engine 10, and FIG. 9 is a rear view illustrating the engine 10. In this embodiment, the exhaust manifold 24 directly communicates with the first and second passages 26 and 28 and is not provided with the exhaust gas cleaning catalyst 33 inside the exhaust passage. That is, the partitioning wall 31 for partitioning the exhaust manifold into the first and second passages 26 and 28 (refer to FIG. 4) is not provided, and the fourth passage 32 is not provided.

That is, the exhaust manifold 24 (manifold body) is solely provided. Other parts are substantially similar to those of the aforementioned case.

It is noted that the front and rear surfaces of the exhaust manifold 24 are not provided with the communication holes 34 and 35 unlike the aforementioned case. In addition, if the communication holes 34 and 35 are provided, they may be covered by the cover plates 40 and 41 described above. Here, they are not illustrated for simplicity purposes.

In the exhaust manifold 24 according to this embodiment, the exhaust gases from each exhaust port 19 flow to the first opening 25 and are joined in the first passage 26. The confluent exhaust gas flows downward inside the first passage 26 and flows to the second passage 28. The exhaust gas flowing from the first passage 26 to the second passage 28 further flows to the third passage 29 of the engine holder 11 through the second opening 27, passes through the exhaust passage provided in the lower unit 103, and is then finally discharged to the water.

In the outboard motor 100 according to the present invention, in particular, the exhaust manifold 24 is configured separately from the cylinder head 15 and the cylinder block 14 and is detachably installed to the body of the engine 10. Here, such a type of outboard motors has different specifications for the output power while they have the same basic configuration such as an engine displacement or arrangement of main components. In addition, there is a demand for engines that can be employed in various nations or regions having different exhaust gas control levels while they have the same basic configuration. If the outboard motor 100 according to the present invention is a catalyst-mounted model, the exhaust manifold 24 is additionally provided with the fourth passage 32 having the exhaust gas cleaning catalyst 33 as illustrated in FIGS. 2 and 6. Meanwhile, in the case of a non-catalyst-mounted model, the fourth passage 32 is not provided in the exhaust manifold 24 as illustrated in FIG. 8. Therefore, it is possible to select whether the exhaust gas cleaning catalyst 33 is installed or not to the same engine 10. As a result, it is possible to implement an outboard motor 100 by which the same engine 10 can be shared between the catalyst-mounted model and the non-catalyst-mounted model.

Since it is not necessary to change the specification of the engine 10 between the catalyst-mounted model and the non-catalyst-mounted model, this is very advantageous in terms of cost such as the number of components and productivity. In addition, since the exhaust manifold 24 can be simply exchanged by removing the bolts 30 as fastening means, it is possible to provide excellent usability and maintainability.

In particular, in the case of the catalyst-mounted model, the fourth passage 32 provided with the exhaust gas cleaning catalyst 33 is additionally provided as illustrated in FIGS. 2 and 6. As a result, it is possible to change the number of exhaust gas cleaning catalysts 33. In this manner, by changing the number of the exhaust gas cleaning catalysts 33 in the same outboard motor 100 as necessary, it is possible to effectively and appropriately adapt the engine specification to various nations or regions having different exhaust gas control levels.

The fourth passage 32 can be divided into the first passage 26 side and the second passage 28 side in the coupling portion 37. The exhaust gas cleaning catalyst 33 can be inserted or extracted through the opening formed in the dividing portion of the fourth passage 32 vertically bisected. Therefore, it is possible to simply exchange the exhaust gas cleaning catalyst 33 as necessary.

In the catalyst-mounted model, the first and second passages 26 and 28 of the exhaust manifold 24 are partitioned by the partitioning wall 31. In addition, in the non-catalyst-mounted model, the first and second passages 26 and 28 directly communicate with each other. In both the catalyst-mounted model and the non-catalyst-mounted model, the first and second passages 26 and 28 are formed integrally. The exhaust gas passing through these passages flows to the third passage 29 disposed in the lower side. Since the exhaust gas passes through the exhaust passage integrated or integrally provided in this manner, it is possible to provide a remarkably compact configuration.

The first passage 26 is installed with the oxygen sensor 38, and the second passage 28 is installed with the oxygen sensor 39. In both the catalyst-mounted model and the non-catalyst-mounted model, or in only the catalyst-mounted model, even by changing the number of the exhaust gas cleaning catalysts 33, it is possible to detect the oxygen concentration in the exhaust gas in the same configuration.

In the aforementioned case, if the exhaust system having the exhaust gas cleaning catalyst 33 is arranged in a concentrative manner in any one of the left and right sides (for example, left side) of the engine 10, it is possible to provide convenience in assembly works. If the exhaust system is arranged oppositely to the intake system and the fuel system, it is possible to guarantee high reliability and safety, for example, even when an engine overheating occurs due to shortage of a coolant in the exhaust system. Furthermore, since components such as the ignition plug or the cylinder head cover 16 can be easily uninstalled, it is possible to provide excellent maintainability.

While various embodiments of the present invention have been described in detail hereinbefore, it would appreciated that they are not intended to limit the present invention, but various changes or modifications may be possible without departing from the spirit and scope of the invention.

For example, although the engine 10 is an in-line four-cylinder engine in the aforementioned embodiment, the number of cylinders in the engine 10 may increase or decrease without a limitation.

According to the present invention, it is possible to select whether the exhaust gas cleaning catalyst is mounted or not to the same engine. Therefore, it is possible to implement an outboard motor capable of accommodating sharing of the engine between the catalyst-mounted model and the non-catalyst-mounted model.

What is claimed is:

1. An outboard motor comprising:

an in-line multi cylinder four-cycle engine comprising:

a cylinder block having a plurality of cylinders arranged side by side along a vertical direction;

a cylinder head that forms each combustion chamber in cooperation with the cylinders of the cylinder block and has exhaust ports connected to the combustion chambers; and pistons reciprocating in a front-rear direction of the outboard motor;

an engine holder that supports the four-cycle engine and connects the engine to a lower unit; and an exhaust manifold comprising:

a first passage that has a plurality of first openings connected to the exhaust ports and extends vertically;

a second passage that is arranged under the first passage and has a second opening provided in a lower end portion and connected to a third passage formed in the engine holder;

a fourth passage branching from an upper portion of the first passage, communicating with the second passage, internally having an exhaust gas cleaning catalyst, extending vertically along the first passage and arranged in line with both a cylinder block side in front of the first passage and a cylinder head side in rear of the first passage; and an oxygen sensor for detecting an oxygen concentration in the exhaust gas is disposed in an upper portion of the first passage or in the second passage of the exhaust manifold, wherein the first and second passages of the exhaust manifold are formed integrally, wherein the exhaust manifold is formed separately from the cylinder head and the cylinder block and is detachably installed, and wherein the first and second passages of the exhaust manifold are partitioned by a partitioning wall.

2. The outboard motor according to claim 1, wherein the fourth passage of the exhaust manifold is detachably installed to a body of the exhaust manifold provided with the first and second passages, and a coupling portion dividable into a first passage side and a second passage side is formed in the middle of the fourth passage.

* * * * *